US006460393B1

(12) United States Patent
Sundhagen

(10) Patent No.: US 6,460,393 B1
(45) Date of Patent: Oct. 8, 2002

(54) METHOD FOR FORMING BUCKLINGS IN A PLATE MEMBER, TOOL AND PLATE

(75) Inventor: Gunnar Sundhagen, Fjerdingby (NO)

(73) Assignee: Lena Sundhagen (NO)

( * ) Notice: Subject to any disclaimer, the term of this patent is extended or adjusted under 35 U.S.C. 154(b) by 0 days.

(21) Appl. No.: 09/142,804

(22) PCT Filed: Mar. 21, 1997

(86) PCT No.: PCT/NO97/00080

§ 371 (c)(1),
(2), (4) Date: Mar. 12, 1999

(87) PCT Pub. No.: WO97/36703

PCT Pub. Date: Oct. 9, 1997

(30) Foreign Application Priority Data

Apr. 1, 1996 (NO) ..... 961328

(51) Int. Cl.[7] ..... B21D 28/10

(52) U.S. Cl. ..... 72/328; 72/326; 52/630; 52/670; 248/220.42

(58) Field of Search ..... 72/326, 325, 332, 72/328, 427; 29/6.1; 52/630, 670; 248/220.42

(56) References Cited

U.S. PATENT DOCUMENTS

| | | | | | |
|---|---|---|---|---|---|
| 493,791 | A | * | 3/1893 | Schurig | 72/326 |
| 2,784,769 | A | * | 3/1957 | Fisher | |
| 2,797,817 | A | * | 7/1957 | Shugarman | 248/220.42 |
| 3,111,977 | A | * | 11/1963 | Kruger | 72/326 |
| 3,851,846 | A | | 12/1974 | Long | |
| 4,453,364 | A | * | 6/1984 | Ting | 52/220.4 |
| 4,510,786 | A | * | 4/1985 | Strangward | 72/326 |
| 4,522,860 | A | * | 6/1985 | Scott | 72/326 |
| 5,318,176 | A | * | 6/1994 | Kapersen | 72/326 |

FOREIGN PATENT DOCUMENTS

| | | | | |
|---|---|---|---|---|
| GB | 510877 | * | 8/1939 | 72/326 |

* cited by examiner

*Primary Examiner*—Daniel C. Crane
(74) *Attorney, Agent, or Firm*—Nixon & Vanderhye PC

(57) ABSTRACT

A method and tool for forming convexities (3, 4) in a plate body (1), which plate body (1) comprises a main face (2) and a plurality of side edges. The plate body (1) is inserted between two tool halves (11, 12), which are brought together and interact to press a first set of convexities (3) in a first direction relative to the main face (2) of the plate body (1) and a second set of convexities (4) in a second, opposite direction relative to the main face (2) of the plate body (1). The convexities (3, 4) are formed along a straight line across the plate body (1) between two of the side edges thereof. The plate body (1) is secured so that the main face (2) thereof maintains its orientation, and each of the convexities (3) in the first set of convexities is pressed out by a length (1), measured from one side of the convexities (3) at a point (20) on the main face (2) of the plate body (1) along the convexity (3) to the second side of the convexity (3) at a point (21) on the main face (2) of the plate body (1), which is substantially equal to the corresponding length (1) by which each of the convexities (4) in the second set of convexities is pressed out.

6 Claims, 4 Drawing Sheets

METHOD FOR FORMING BUCKLINGS IN A PLATE MEMBER, TOOL AND PLATE

BACKGROUND OF THE INVENTION

The present invention relates to a method for forming convexities in a plate body, a tool for forming convexities in a plate body and a plate having convexities formed therein.

A method, a tool and a plate in accordance with the above are known from U.S. Pat. No. 5,318,176. This publication teaches a rail that is produced by placing a plate-shaped body in a tool, which forms convexities in two opposite directions relative to the main face of the plate body. However, at the same time as the convexities are formed, the plate is also bent so that it becomes essentially U-shaped in cross-section. Owing to the substantial bending of the plate, only rail-shaped bodies having just one row of convexities can be made by means of this method and tool. A plate of greater extent and having several rows of convexities cannot be produced using the taught method and tool.

U.S. Pat. No. 3,851,846 teaches a plate-shaped body where convexities are formed in opposite directions. However, these convexities are only made at one side edge of the plate, which results in tension arising in the juncture between the innermost convexity and the distal planar portion of the plate. It is therefore not possible to produce such convexities over a major area of the plate, since these convexities will result in the plate twisting markedly. Also, the plate is only intended to receive an adjustable leg of a dishwasher.

U.S. Pat. No. 3,062,570, U.S. Pat. No. 3,208,505 and U.S. Pat. No. 4,711,420 teach other variants of plates equipped with convexities. All the plates are produced with specific uses in view, such as a comer connector for a stand, a holder for a burner and a post for use in a shopfitting system. None of these publications teach convexities which are suitable for arranging over a major extent of a plate.

SUMMARY OF THE INVENTION

The main objective of the present invention is to make possible the provision of convexities over a larger area of a plate than is possible with the known methods and tools. A plate of this kind having convexities over a major area of the plate, for example, across the entire plate, may, for instance, be used as a suspension plate, for use, for example, in a shopfitting system; as a substructure for a floor, wherein the plate has convexities ensuring a suitable distance between, for example, a wooden floor and a concrete floor, and may also be made of a somewhat yielding material so that it springs a little under pressure; as a sound-absorbing wall in that, for example, two such plates can be arranged with insulation therebetween, where the purpose of the convexities is to scatter the reflected sound; as a lamp shade, wherein a light source is mounted on the back of the plate and the plate serves to disperse the light so as to provide indirect illumination from, for example, a wall or a ceiling; as anchoring for, for instance, reinforcement bars, in that the plate can form a connection between several reinforcing rods and hold them correctly spaced apart; as decorative plates on walls or ceilings, optionally also for decorative purposes on other articles, e.g., lamp shades; and as a hinge connection, the convexities formed along the respective side edges of two plates being intermeshed and a hinge pin fed through the convexities.

The aforementioned are merely examples of the use of a plate produced according to the method of the invention and using the tool of the invention. More possible uses will almost certainly come to light as the invention begins to be used.

The above-mentioned possibilities are achieved by a method for forming first and second oppositely directed sets of convexities, wherein the plate body is secured so that the main face thereof maintains its orientation and each of the convexities in the first set of convexities is pressed out by a length which is substantially equal to the corresponding length by which each of the convexities of the second set of convexities is pressed out.

The above-mentioned possibilities are further achieved by means of a tool comprising first and second tool halves, the tool halves having a plurality of projections arranged along a straight line and being separated by a plurality of spaces so that the projections on the first half fit into the spaces on the second half and vice versa, and wherein when the tools halves are brought completely together, the projections on the first tool half are of a length which is equal to the corresponding length across the projections on the second tool half.

The above mentioned possibilities are also achieved by providing a plate in which first and second sets of convexities are formed in opposite directions, the convexities of the first set having a length which is substantially equal to the corresponding length of each of the convexities of the second set of convexities.

BRIEF DESCRIPTION OF THE DRAWINGS

The invention will now be explained in more detail with reference to the accompanying drawings, wherein:

FIGS. 1*a, b* and *c* are sectional views of different possible embodiments of a plate according to the invention;

DETAILED DESCRIPTION OF THE INVENTION

Figure 1A:
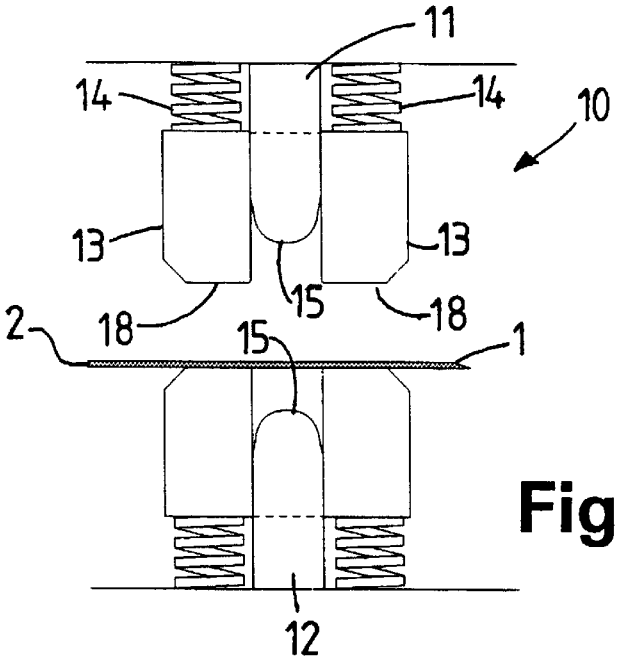
FIGS. 1*a, b*, and *c* show a tool according to the present invention in three different stages of the production of a plate according to the invention, using the method of the invention.

FIG. 1*a* illustrates a tool 10, consisting of a first tool half 11 and a second tool half 12. On each side of each tool half 11, 12 there is provided a combined ejector and rest 13 for a plate 1. The ejectors are each pre-tensioned pairwise against one another by means of a spring 14.

Figure 2:
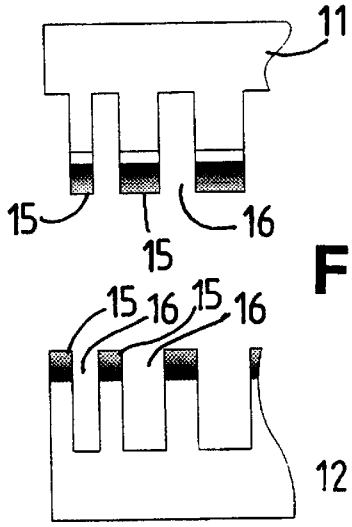
FIG. 2 is a fragmentary lateral view of a tool according to the invention.

Each tool half 11, 12 is equipped with a plurality of projections 15, which are best illustrated in FIG. 2. Spaces 16 are formed between the projections. The tool halves 11, 12 are configured so that the projections 15 on the tool half 11 fit into the spaces 16 on the tool half 12, and vice versa. A plate 1 is inserted between the tool halves 11, 12, which plate comprises a main surface 2 and a number of side edges.

Figure 1B:
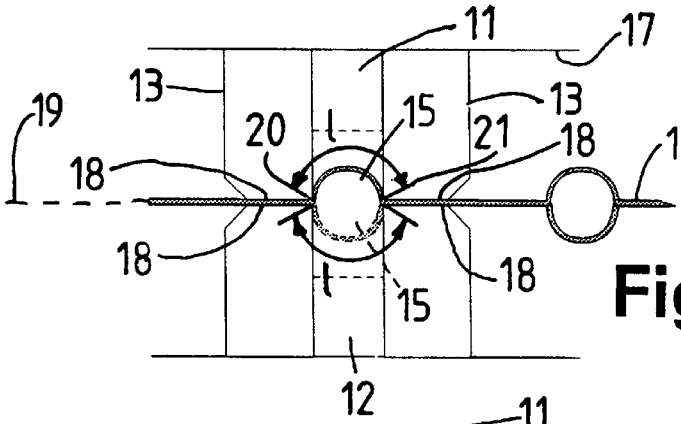

In FIG. 1*b* the two tool halves 11, 12 are brought completely together. The ejectors 13 here are pressed right in against their springs 14, so that they come to rest against a tool holder 17. The movement of the tool halves 11, 12 towards each other then comes to a standstill. The opposing faces 18 of the ejectors 13 rest against the plate 1, and the plate 1 and the faces 18 of the ejectors 13 define the dividing plane 19 of the tool. The projections 15 of the first tool half 11 project beyond the dividing plane 19 by a length 1, measured from the dividing plane 19 of the tool at a point 20 along the projection 15, across the top of the projection, to the dividing plane 19 of the tool at a point 21 on the opposite side of the projection 15. The projections 15 of the second tool half 12 also project beyond the dividing plane 19 of the tool by the same length 1, but in the opposite direction. Therefore, an equally large amount of plate material, measured in the figured plane of FIG. 1*b*, is pressed out to each side of the dividing plane 19 of the tool, thereby ensuring that the plate is substantially free from tension, even after the convexities have been formed.

Figure 1C:
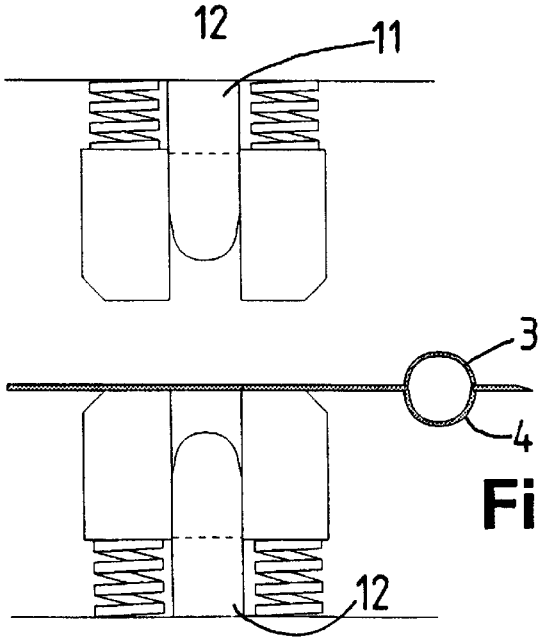

In FIG. 1*c* the tool halves 11, 12 are again drawn apart from one another, and in the plate 1 a number of convexities 3, 4 are formed which extend from one side edge of the plate in a straight line to the opposite side edge of the plate.

Figure 3A:
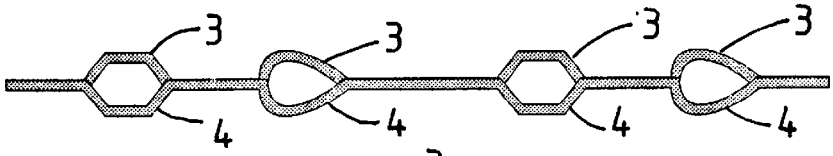
Figure 3B:
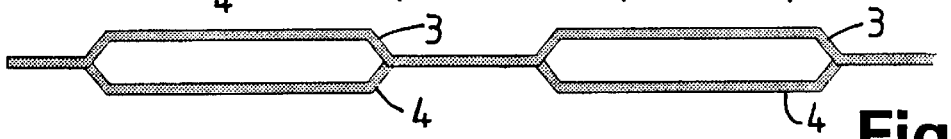
Figure 3C:
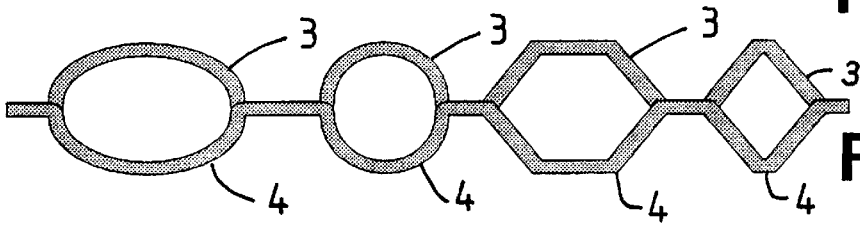

The shape of the convexities 3, 4 can be adapted according to the application of the plate. The only condition set is that the convexities lying along the same straight line have the same length measured along the convexity from the main face of the plate on one side of the convexity to the main face of the plate on the other side of the convexity. As can be seen from FIGS. 3*a*–3*c*, all the convexities 3, 4 arranged pairwise opposite each other are of the same length measured along the convexity. However, convexities formed along different lines may be of different lengths. The extent of the convexities along the straight line from plate edge to plate edge and the height of arch of the convexities measured from the principal plane of the plate are of no importance and can be adjusted according to use. Thus, the convexities on the same line may have different cross-sectional shapes. The straight lines along which the convexities lie, do not need to be parallel to each other, but may be at a randomly selected angle to each other.

The row of convexities must extend from one side edge of the plate in a straight line to the other side edge of the plate. When the convexities are formed in this way a tension-free plate is obtained which maintains its original principal shape. The plate will twist or bend to a very small degree, apart from the actual convexities, and the plate will be easy to bend into a desired shape once the convexities have been formed. Before, after, or at the same time as the pressed-out portions are formed, recesses may optionally also be punched out in the plate. The recesses may be located between the convexities in one line, or they may be located between the convexities in two adjacent lines.

Figure 4:
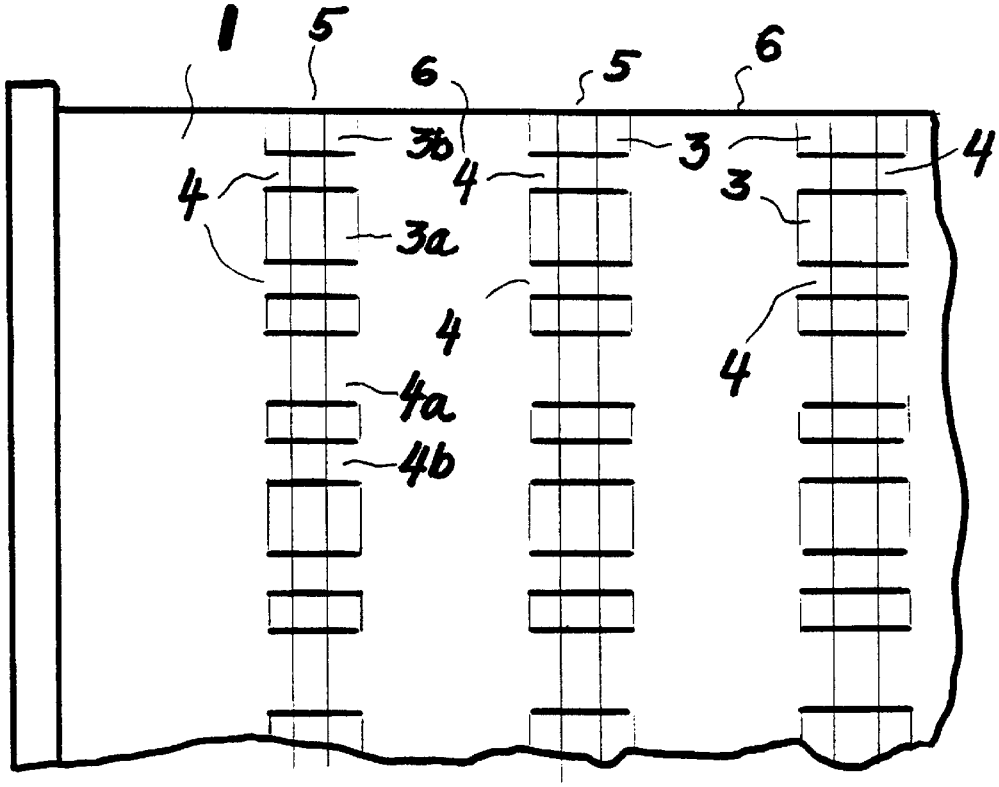
FIG. 4 is a fragmentary plan view of a plate according to the invention.
Figure 5:
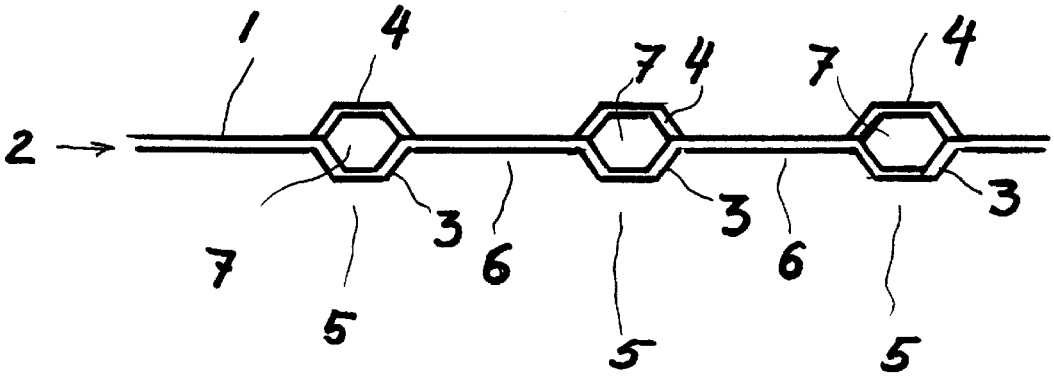
FIG. 5 is a sectional view of the plate of FIG. 4.
Figure 6:
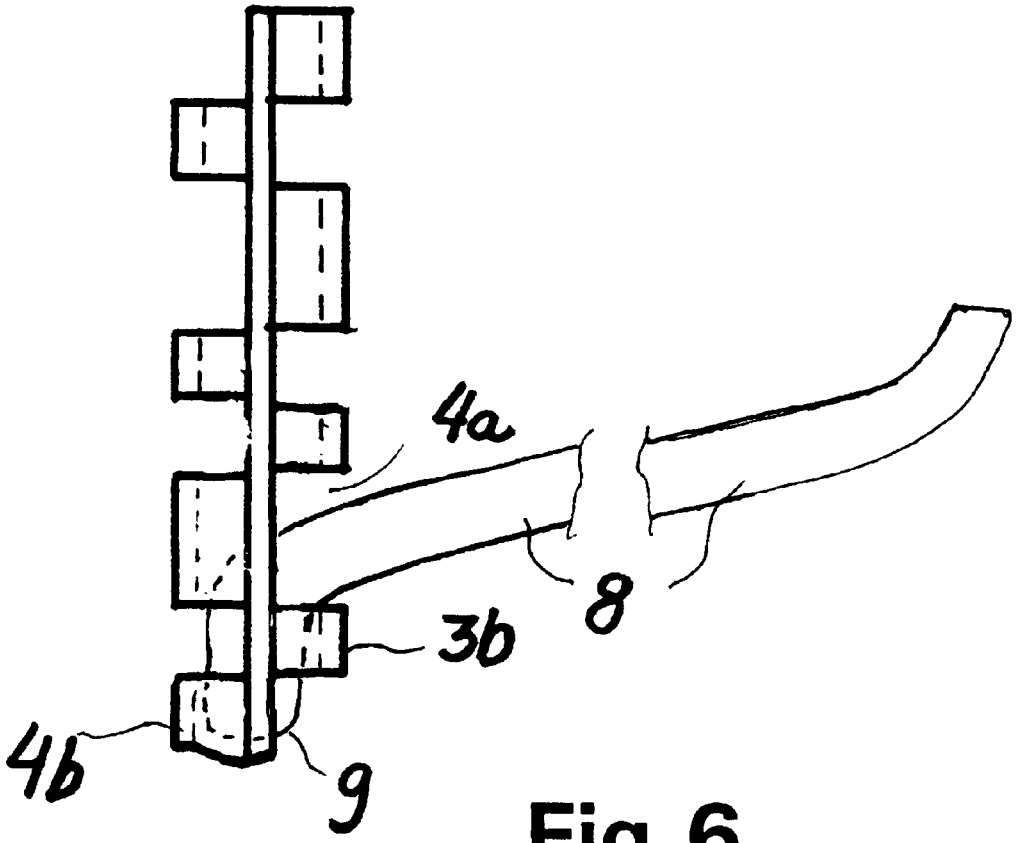
FIG. 6 is a lateral view of the plate of FIG. 4, used as a suspension plate.

In FIGS. 4, 5 and 6, a plate 1 is shown which in general comprises a first side face 2*a* and a second side face 2*b*. From this plate 1, areas 3 are pressed out in a first direction, so that the areas 3 form a curved face at a distance from the first side face 2*a*. Other areas 4 are pressed out from the plate 1 in an opposite direction and form a second curved face at a distance from the second side face 2*b*, so that the areas and 4 are in alternating relation in a row 5 across the plate. A plurality of such rows 5 can be arranged at a distance from each other, and define areas 6 between each other, which areas 6 are in the planar main portion 2 of the plate. Between each of the areas 3 and 4, openings 7 are formed for the insertion of, for example, a hook 8 (see FIG. 6), bolts, thread, wires, cables, pipes and so forth.

The alternating areas 3 and 4 are alternately formed having a short and a long length. Thus, the areas 3*a* have a longer length than the areas 3*b*, and likewise the areas 4*a* have a longer length than the areas 4*b*. When the inner end 9 of the hook 8 is to be fixed in the plate 1, the end 9 is inserted towards, for example, an area 4*a*, and then passed down through the opening 7 behind an area 3*b* until the end 9 reaches an area 4*b*. The end 9 of the hook 8 is then retained between the areas 4*a*, 3*b* and 4*b*.

The pressed-out areas 3 and 4 may have any chosen cross-sectional form, e.g., a circular cross-sectional form. With the circular cross-sectional form, it is possible to arrange hooks so as to be capable of swinging on the plate 1.

FIG. 6 shows a section of the plate 1 where the alternating areas 3 and 4 are plain to see. The areas are arranged in a row following a repetitive pattern: A short area 3*b*, a short area 4*b*, a long area 3*a*, a short area 4*b*, a short area 3*b* and a long area 4*a*. Naturally, other patterns of alternating areas are also possible, depending upon what is to be secured to the plate.

Although in the exemplary embodiment, a plate is shown that is primarily intended as a suspension means for hooks or the like, this plate can be used in virtually any situation where it is desirable to hold together various elements. One example may be the fastening together of reinforcing rods for reinforcing, for instance, concrete. A plate may then, for example, be bent into a cylinder and held in this position by means of bars disposed substantially diametrically on the inside of the cylinder and secured in the openings 7, in the same way as the hooks 8. On the outside reinforcing rods can be inserted through the openings 7 along the rows 5. Several cylinders of this kind can be arranged along the reinforcing rods. In this way good reinforcement will be obtained for making, e.g., pillars or columns.

As mentioned in the introduction, other applications of the plate of the invention are also conceivable, and the invention is therefore not limited to only the said areas of application, but can be used in any area whatsoever where it is desirable to have a tension-free plate provided with pressed-out portions in opposite directions.

What is claimed is:

1. A tool comprising a first and a second tool half, the tool having a dividing plane, wherein said tool halves have a plurality of convexity forming projections arranged along a straight line and separated by a plurality of spaces, said projections on said first tool half fitting into said spaces on said second tool half, and vice versa, wherein each tool half is provided with a pair of ejectors, with one said ejector disposed on each lateral side of the convexity forming projections of the tool half, each said ejector having a contact face which is situated in said dividing plane of the tool when said tool halves are brought completely together to firmly secure a main face of a plate body between said contact faces, so that the main face of said plate body is maintained in said dividing plane of the tool and secured between said ejectors throughout substantially the entire forming of convexities with said plurality of projections over a large area of the plate body, to prevent the plate body from twisting, wherein said projections on said first tool half are of a length, measured from a point in said dividing plane of the tool, across the top of said projection to a point in said dividing plane on the opposite side of said projection, which is equal to the corresponding length across said projections on said second tool half.

2. A tool according to claim 1, wherein said ejectors are equipped with springs, which pre-tension the ejectors pairwise against each other.

3. A method for forming convexities over a large area of a plate body while preventing the plate body from twisting due to the forming of convexities, comprising:

providing a plate body having a first face and a second face;

providing a tool having two tool halves and a dividing plane therebetween, each said tool half having a plurality of convexity forming projections arranged along a straight line and each said tool half having a pair of ejectors, one said ejector being disposed on each lateral side of said convexity forming projections, each said ejector extending in parallel to said straight line and having a contact face for bearing against a respective one of the first and second faces of the plate body;

inserting said plate body along said dividing plane between said tool halves;

bringing said tool halves together so as to firmly secure said plate body between said contact faces of said ejectors so that said plate body is maintained in said dividing plane of the tool; and while said plate is held by said ejectors, pressing a first set of convexities in a first direction relative to a plane of the plate body, and a second set of convexities in a second, opposite direction relative to the first direction with said convexity forming projections of each tool half, said convexities being formed along a straight line across the plate body between two side edges thereof, each of the convexities in the first set of convexities being pressed out by a length, measured from one side of the convexity along the convexity to the other side of the convexity, which is substantially equal to the corresponding length by which each of the convexities of the second set of convexities is pressed out, wherein said plate is held by said ejectors throughout substantially the entire forming of said first and second sets of, convexities.

4. A method according to claim 3, wherein recesses are punched out in the plate body at the same time that the convexities are formed.

5. A plate, comprising a main face and a plurality of side edges, in which plate there are formed a first set of convexities in a first direction relative to the main face of the plate and a second set of convexities in a second direction relative to the main face, wherein said convexities in said first set of convexities are of a length, measured from one side of said convexity at a point on said main face along said convexity to said other side of said convexity at a point on said main face of said plate body, which is substantially equal to said corresponding length of each of said convexities in said second set of convexities, said plate being equipped with pressed-out portions in a repetitive pattern over at least a major part of said extent of said plate and arranged in lines transverse of said length of said convexities, wherein said pattern of pressed-out portions is composed of:

a first area which forms a curved face projecting from a first planar side face of the plate;

a second area which forms a curved face projecting out from an opposing second planar side face of the plate;

said first area abutting on said second area whereby an opening is formed through the plate at the boundary line between said first and said second area, which opening is directed substantially parallel to said planar portion of said plate, where respectively said first area and said second area are connected to the plate along at least a part of respectively said first and said second area, and wherein said pattern formed by said first and second areas emerges as an identical, repetitive pattern on both sides of the plate, wherein said pattern comprises areas which are of alternating different lengths in the direction of said lines, wherein said areas alternate in the following pattern:

a short area projecting out from said first side of the plate, a short area projecting out from said opposite second side of the plate, a long area projecting out from said first side of the plate, a short area projecting out from said opposite second side of the plate, a short area projecting out from said first side of the plate, and a long area projecting out from said opposite second side of the plate.

6. A plate and hook combination, the plate comprising a main face and a plurality of side edges, in which plate there are formed a first set of convexities in a first direction relative to the main face of the plate and a second set of convexities in a second direction relative to the main face of the plate, wherein said first set of convexities are of a length, measured from one side of said convexity at a point on said main face along said convexity to said other side of said convexity at a point on said main face of said plate body, which is substantially equal to said corresponding length of each of said convexities in said second set of convexities, said plate being equipped with pressed-out portions in a repetitive pattern over at least a major part of said extent of said plate and arranged in lines transverse of said length of said convexities, wherein said pattern of pressed-out portions is composed of:

a first area which forms a curved face projecting from a first planar side face of the plate;

a second area which forms a curved face projecting out from an opposing second planar side face of the plate;

said first area abutting on said second area whereby an opening is formed through the plate at the boundary line between said first and said second area, which opening is directed substantially parallel to said planar portion of said plate, where respectively said first area and said second area are connected to the plate along at least a part of respectively said first and said second area, and wherein said pattern formed by said first and second areas emerges as an identical, repetitive pattern on both sides of the plate, wherein said pattern comprises areas which are of alternating different lengths in the direction of said lines in the following pattern:

a long area projecting out from said first side of the plate, a short area projecting out from said opposite second side of the plate, the hook having a leg portion to be inserted between convexities in said first set and said second set, wherein said long area have a length which is substantially equal to or slightly longer than the length of said leg, said short area have a length which is shorter than the length of said leg.

* * * * *